US011021938B2

(12) United States Patent
Reeves et al.

(10) Patent No.: US 11,021,938 B2
(45) Date of Patent: Jun. 1, 2021

(54) GAS LIFT SYSTEMS, FLOW REGIME MODIFIERS, AND RELATED METHODS

(71) Applicant: Baker Hughes Holdings LLC, Houston, TX (US)

(72) Inventors: Brian Reeves, Edmond, OK (US); Jinfeng Zhang, Edmond, OK (US)

(73) Assignee: Baker Hughes Holdings LLC, Houston, TX (US)

( * ) Notice: Subject to any disclaimer, the term of this patent is extended or adjusted under 35 U.S.C. 154(b) by 1 day.

(21) Appl. No.: 16/239,370

(22) Filed: Jan. 3, 2019

(65) Prior Publication Data

US 2020/0217179 A1 Jul. 9, 2020

(51) Int. Cl.
*E21B 43/12* (2006.01)

(52) U.S. Cl.
CPC ..... *E21B 43/122* (2013.01)

(58) Field of Classification Search
CPC ..... E21B 43/122; E21B 43/13
See application file for complete search history.

(56) References Cited

U.S. PATENT DOCUMENTS 4,179,222 A 12/1979 Finch et al.
5,431,228 A * 7/1995 Weingarten ..... B01D 17/00 166/357
6,200,103 B1 3/2001 Bender
9,951,598 B2 4/2018 Roth et al.
2004/0123987 A1 7/2004 Reitz
2004/0238055 A1 12/2004 Martin et al.
2006/0045757 A1 3/2006 Parr
2015/0114318 A1* 4/2015 Zhang ..... F22B 37/18 122/1 C
2015/0167434 A1 6/2015 Mao et al.

FOREIGN PATENT DOCUMENTS

CN 107044274 A 8/2017
CN 207268172 U 4/2018
KR 10-2016-0032202 A 3/2016
(Continued)

OTHER PUBLICATIONS

Singh et al., Unconventional Cyclone Gas Lift Completion for Offshore Wells of Cambay Basin: A Smart Completion to Optimize Production and Well Intervention, Society of Petroleum Engineers, SPE-181574-MS, (Sep. 2016), 20 pages.
(Continued)

*Primary Examiner* — George S Gray
(74) *Attorney, Agent, or Firm* — TraskBritt

(57) ABSTRACT

A gas-lift well includes a casing extending down a wellbore, production tubing extending within the casing, a gas system for inserting compressed gas into an annular space between the casing and the production tubing, at least one gas-lift input, and at least one fluid flow regime modifier. The at least one gas-lift input extends from the annular space, through the production tubing, and to an interior of the production tubing. The at least one fluid flow regime modifier is disposed within the production tubing and is at least partially within a fluid column of the production tubing, the at least one fluid flow regime modifier is configured to reduce fluid fallback and impart a turbulent flow regime to at least a portion of the fluid column.

6 Claims, 8 Drawing Sheets

(56) References Cited

FOREIGN PATENT DOCUMENTS

| | | |
|---|---|---|
| KR | 10-1824609 B1 | 2/2018 |
| RU | 2483213 C1 | 5/2013 |

OTHER PUBLICATIONS

Miller, Colin McKay, Downhole Tools Boost Flow in Unconventional Completions, http://www.upstreampumping.com/article/production/2015/downhole-tools-boost-flow-unconventional-completions, Mar. 11, 2015, 6 pages.
International Search Report for International Application No. PCT/US20/12088, dated Apr. 28, 2020, 5 pages.
International Written Opinion for International Application No. PCT/US20/12088, dated Apr. 28, 2020, 7 pages.

* cited by examiner

GAS LIFT SYSTEMS, FLOW REGIME MODIFIERS, AND RELATED METHODS

FIELD

This disclosure relates generally to cutting elements for gas-lift wells. More specifically, disclosed embodiments relate to fluid flow regime modifiers that are disposed and/or formed within production tubing of gas-lift wells.

BACKGROUND

Gas-lift wells are particularly useful in increasing efficient rates of oil production where the reservoir natural lift is insufficient. Typically, in a gas-lift oil well, natural gas produced in the oil field is compressed and injected in an annular space between a casing and tubing and is directed from the casing into the tubing to provide a "lift" to the tubing fluid column to increase production out of a reservoir. In some instances, the tubing can be used for the injection of the lift-gas, and the annular space used to produce the oil; however, this is uncommon in practice. In initial attempts, the gas-lift wells simply injected the gas at the bottom of the tubing, but with deep wells, this requires excessively high kick off pressures. Subsequent methods were devised to inject the gas into the tubing at various depths in the wells to avoid some of the problems associated with high kick off pressures.

Additional types of gas-lift well use mechanical, bellows-type gas-lift valves attached to the tubing to regulate the flow of gas from the annular space into the tubing string. In a typical bellows-type gas-lift valve, the bellows is preset or pre-charged to a certain pressure such that the valve permits communication of gas out of the annular space and into the tubing at the pre-charged pressure. The pressure charge of each valve is selected by an application engineer depending upon the position of the valve in the well, the pressure head, the physical conditions of the well downhole, and a variety of other factors, some of which are assumed or unknown, or will change over the production life of the well.

BRIEF SUMMARY

Some embodiments of the present disclosure include gas-lift well system including a casing extending down a wellbore and production tubing extending within the casing. The gas-lift well system further includes a gas system for introducing compressed gas into an annular space between the casing and the production tubing, at least one gas-lift input extending from the annular space to an interior of the production tubing, and at least one fluid flow regime modifier within the production tubing and at least partially within a fluid column of the production tubing, the at least one fluid flow regime modifier configured to reduce fluid fallback and impart a turbulent flow regime to at least a portion of the fluid column.

Some embodiments of the present disclosure include gas-lift well system including a casing extending down a wellbore and production tubing extending within the casing. The gas-lift well system further includes a gas system for introducing compressed gas into an annular space between the casing and the production tubing, at least one gas-lift input extending from the annular space to an interior of the production tubing, and at least one fluid flow regime modifier within the production tubing and at least partially within a fluid column of the production tubing, the at least one fluid flow regime modifier configured to reduce fluid fallback and cause fluid flow within the fluid column proximate a wall of the production tubing to move toward a center of the fluid column and fluid flow near a center of the fluid column to move toward the wall of the production tubing.

Additional embodiments of the present disclosure include a method of installing a fluid flow regime modifier. The method may include providing at least one fluid flow regime modifier within production tubing of a wellbore and at least partially within a fluid column of the production tubing, the at least one fluid flow regime modifier configured to reduce fluid fallback and impart a turbulent flow regime to at least a portion of the fluid column.

DETAILED DESCRIPTION

Figure 1:
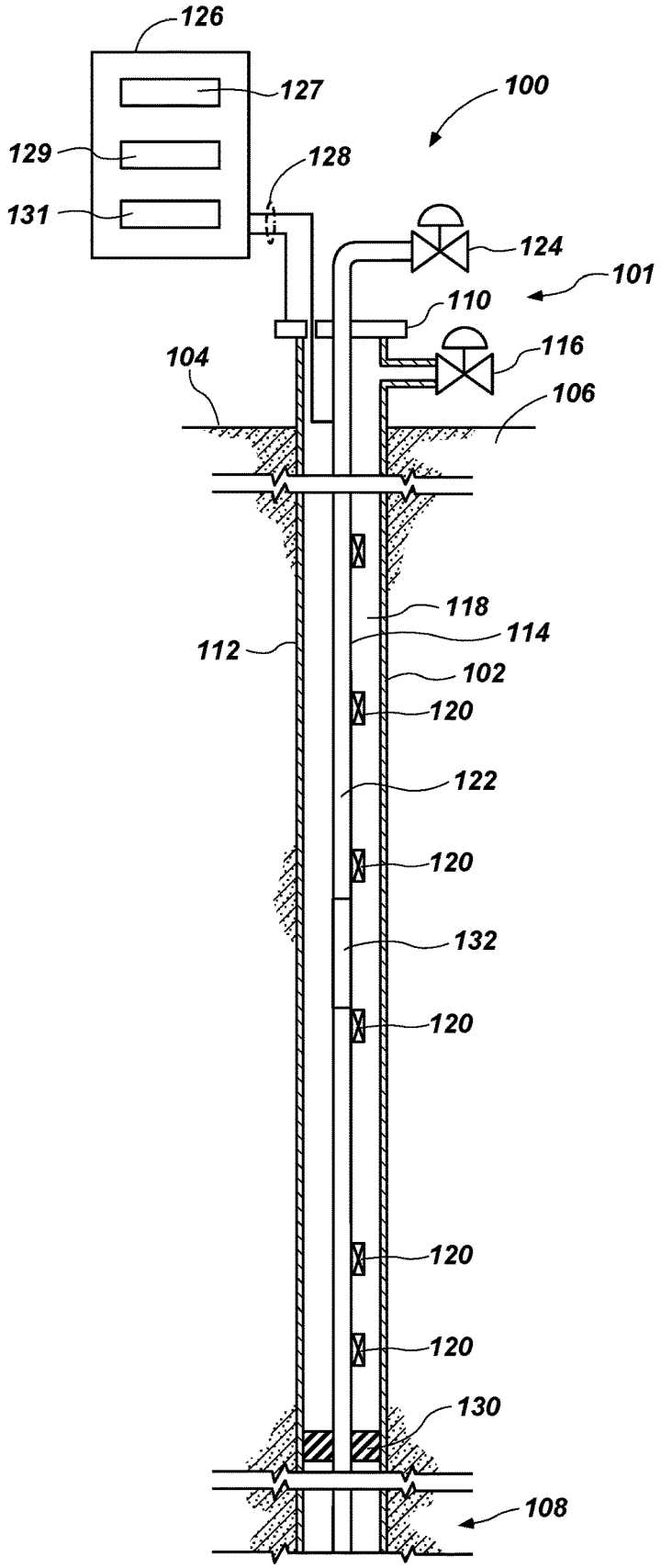
FIG. 1 is a simplified schematic diagram of an example of a gas-lift well according to one or more embodiments of the present disclosure.

The illustrations presented herein are not actual views of any gas-lift well, production tubing, or flow regime modifier, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "below," "lower," "bottom," "above," "upper," "top," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

FIG. 1 is a schematic diagram of an example of a gas-lift well 100 according to one or more embodiments of the present disclosure. The gas-lift well 100 may include a borehole 102 extending from a surface 104 of a formation 106 into a production zone 108 (e.g., hydrocarbon reservoir) that is downhole, as is known in the art. The gas-lift well 100 may include a production platform 101 located at the surface 104 that includes a hanger 110 supporting a casing or liner string 112 and production tubing 114 (i.e., tubing string). The casing string 112 may include any conventional casing or liner tubulars utilized in the oil and gas industry.

In some embodiments, the casing string 112 includes multiple sections and is secured (e.g., cemented) in the borehole 102. In one or more embodiments, the production tubing 114 may include a plurality of elongated tubular pipe sections joined by threaded couplings at each longitudinal end of the pipe sections. In additional embodiments, the production tubing 114 may include continuous coiled tubing.

The gas-lift well 100 may further comprise a gas-lift system including a gas input 116 for introducing compressed gas into an annular space 118 defined between the casing string 112 and the production tubing 114. The gas-lift well 100 may further include at least one gas-lift input 120 extending from the annular space 118, through a wall of the production tubing 114, and to an interior 122 of the production tubing 114. In some embodiments, the at least one gas-lift input 120 may include a valve (e.g., a conventional bellows-type gas-lift valve). In additional embodiments, the at least one gas-lift input 120 may include an aperture. In further embodiments, the at least one gas-lift input 120 may extend through a longitudinal end wall (e.g., comprise an opening) of the production tubing 114. The production tubing 114 may include an output 124 located at the surface 104 that enables expulsion of hydrocarbon fluids (e.g., oil) and gas bubbles from the interior 122 of the production tubing 114 during oil production. In some embodiments, the gas-lift well 100 may include a packer 130 disposed within the casing string 112 downhole and above the production zone 108 and serving to isolate the production zone 108.

The gas-lift well 100 may also include a control system 126 for operating the production platform 101. The control system 126 may include communication lines 128 extending to the production platform 101, the at least one gas-lift input 120, the output 124, the gas input 116, and/or other elements of the gas-lift well 100. The control system 126 may include a processor 127 and a data storage device 129 (or a computer-readable medium) for storing data, algorithms, and computer programs 131. The data storage device 129 may be any suitable device, including, but not limited to, a read-only memory (ROM), a random-access memory (RAM), a flash memory, a magnetic tape, a hard disk, and an optical disk. The control system 126 may operate and control the gas-lift well 100.

As is known in the art, in operation, the gas input 116 of gas-lift well 100 injects compressed gas into the annular space 118, which results in gas being injected into the interior 122 of the production tubing 114 through the at least one gas-lift input 120 and into any liquid (e.g., hydrocarbons (i.e., oil)) within the production tubing 114. The gas and liquid mixture forms a two-phase fluid column within the production tubing 114. The injected gas returns to the surface 104 through the output 124 while contributing to a reduced fluid density in the fluid column. Reducing the fluid density enables increased fluid production from a hydrocarbon reservoir. For instance, the gas-lift well 100 may generally operate in conventional manners.

Referring still to FIG. 1, the gas-lift well 100 further includes at least one fluid-flow regime modifier 132 (referred to hereinafter as "flow regime modifier" 132) disposed and/or formed within the production tubing 114. As is described in greater detail in regard to FIGS. 2-11, the flow regime modifier 132 may disrupt multiphase flow regimes of the fluid column as the multiphase flow regimes occur within the production tubing 114. Additionally, the flow regime modifier 132 may enable a more efficient production of hydrocarbons (e.g., oil).

Figure 2:
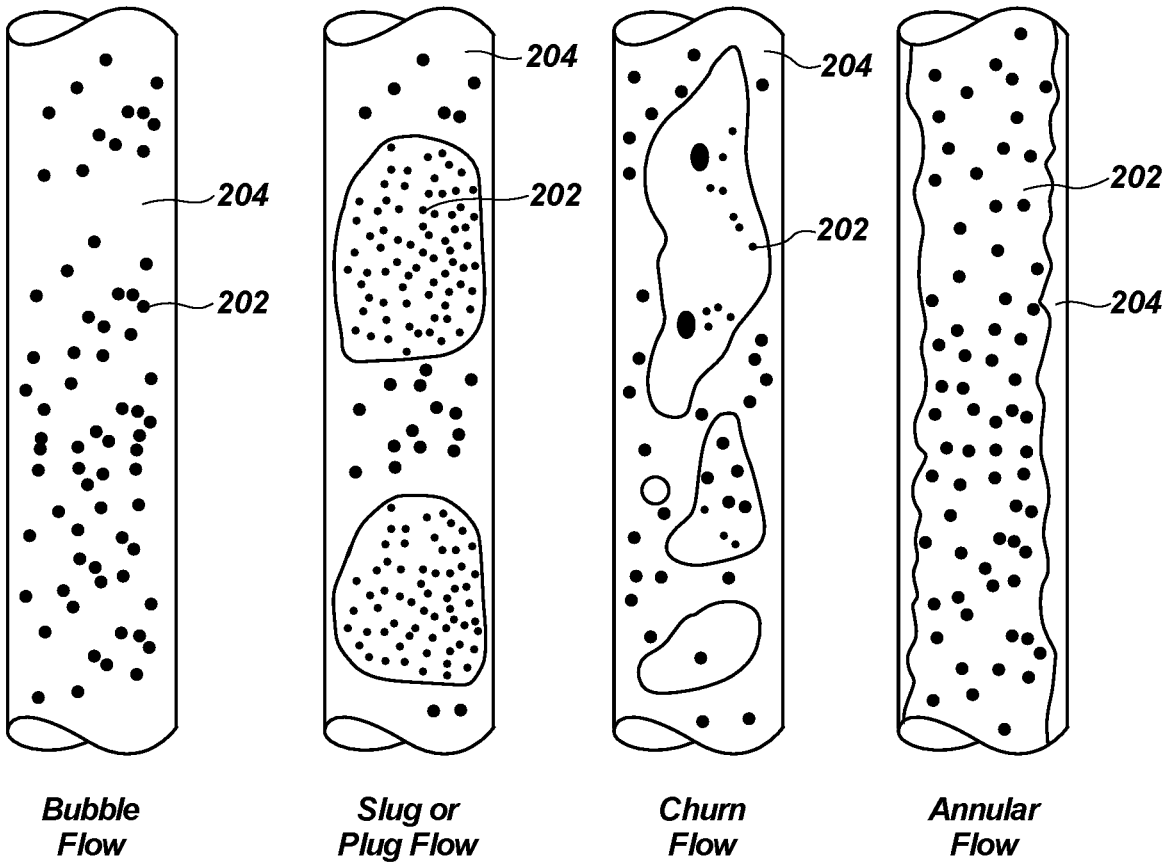
FIG. 2 shows schematic representations of different types of two-phase fluid flow within a range of a fluid flow regimes.

FIG. 2 shows schematic representations of different types of two-phase fluid flow within a range of a fluid flow regimes. The fluid flow regimes depicted in FIG. 2 may be experienced in vertical flow applications. Referring to FIG. 2, in bubble flow, the gas 202 to liquid 204 ratio is relatively small. The gas 202 is present within the two-phase fluid as small bubbles that are randomly distributed throughout the liquid 204 and whose diameters are also random. The bubbles often move at different velocities depending on their respective diameters. In bubble flow, there is relatively little to no momentum transferred from the gas 202 to the liquid 204 as the gas 202 bubbles simply slip past the relatively stationary liquid 204.

In slug or plug flow, the gas phase is more pronounced than in bubble flow. The liquid 204 remain continuous, and the gas 202 bubbles coalesce to form stable bubbles of approximately the same size and shape and which are nearly the diameter of a pipe (e.g., production tubing 114) through which the two-phase fluid is flowing. The gas 202 bubbles are separated by slugs/plugs of liquid 204, and the slugs/plugs of liquid 204 are typically pushed by the rising gas 202 bubbles. However, the liquid 204 continues to slip down past the rising gas 202 bubbles (i.e., experience fluid "fallback"). As a result, the velocity of the gas 202 bubbles is typically greater than that of the liquid 204.

Churn flow (also known as "transition flow") tends to be where the highest liquid 204 production occurs (i.e., the highest rate of liquid 204 is being output at a top of the pipe). Churn flow includes a transition phase from a continuous liquid phase to a continuous gas phase.

In annular flow, the gas phase is continuous, and a majority of the liquid 204 is entrained and carried in the gas phase. Furthermore, in annular flow, very little liquid 204 experiences fluid fallback. However, a majority of the gas 202 traveling up the center of the pipe contributes to frictional losses in the pipe and reduces liquid 204 production. The churn flow regime and the annular flow regime are turbulent flow regimes.

Referring to FIGS. 1 and 2 together, the flow regime modifier 132 disposed within the production tubing 114 and within the fluid column may impart a turbulent flow regime in the fluid column. For instance, the flow regime modifier 132 may cause fluid flow of the fluid column proximate a wall of the production tubing 114 to move toward a center of the fluid column, and the flow regime modifier 132 may cause fluid flow of the fluid column near a center of the fluid column to move toward the wall of the production tubing 114. As a result, the flow regime modifier 132 may cause the fluid column to be more homogeneous throughout the cross-sectional portion of the fluid column effected by the flow regime modifier. Causing the gas phase and the liquid phase to be mixed more homogeneously, fluid fallback may be reduced and/or substantially prevented.

In some embodiments, a geometry of the flow regime modifier 132 may cause a turbulent flow regime in the fluid column that causes the gas phase and liquid phase to mix. The mixing helps to reduces fluid fallback due to the upward flow of the gas 202. Additionally, the flow regime modifier 132 adds solid surface area within the production tubing 114, and while the solid surface area may add a friction component to the fluid flow, the solid surface area increases a level of surface tension between the liquid 204 and the outer surface of the flow regime modifier 132. The increased surface tension between the liquid and the outer surface of the flow regime modifier 132 assists in reducing fluid fallback. Moreover, in some embodiments, the flow regime modifier 132 reduces a cross-sectional area through which the two-phase fluid can flow. As a result, the flow regime modifier 132 increases a velocity at which the two-phase fluid travels through the production tubing 114. The increased velocity enables a same amount of energy to be transferred from the gas 202 to the liquid 204 with less overall injected gas 202. Accordingly, the flow regime modifier 132 increases an effectiveness of the injected gas 202.

Referring still to FIGS. 1 and 2 together, in some embodiments, the flow regime modifier 132 may extend at least substantially an entire longitudinal length of the production tubing 114. In additional embodiments, the flow regime modifier 132 may extend through only a portion of the longitudinal length of the production tubing 114. For instance, the flow regime modifier 132 may only extend through a section of the production tubing 114. In further embodiments, the gas-lift well 100 may include a plurality of flow regime modifiers 132 each disposed at a same or different locations along a longitudinal length of the production tubing. The flow regime modifier 132 is described in greater detail below in regard to FIGS. 3-11.

Figure 3:
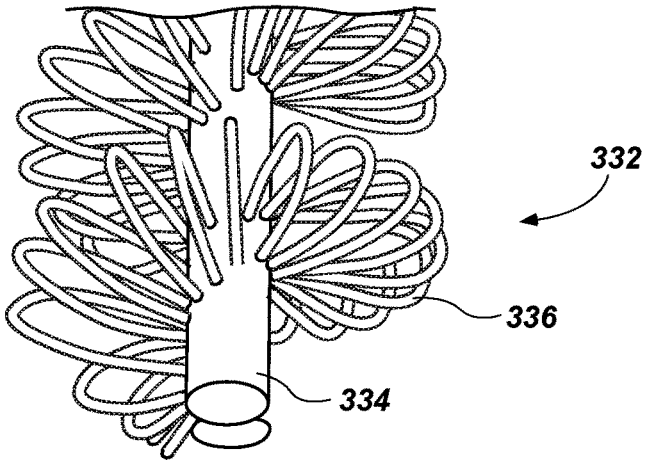
FIG. 3 is a perspective view of a flow regime modifier according to one or more embodiments of the present disclosure.

FIG. 3 is a perspective view of a flow regime modifier 332 according to one or more embodiments of the present disclosure. Referring to FIGS. 1 and 3 together, in some embodiments, the flow regime modifier 332 may include a central rod 334 with a plurality of elongated fin members 336 extending radially outward from the central rod 334.

In one or more embodiments, each of the elongated fin members 336 may include a loop of material extending from a first axial position along the longitudinal length of the central rod 334 to a different, second axial portion along the longitudinal length of the central rod 334. In some embodiments, a distance in which each elongated fin member 336 extends radially may be greater than a distance in which each elongated fin member 336 extends axially along the longitudinal length of the central rod 334. For instance, each elongated fin member 336 may be elongated in a radial direction. Furthermore, the plurality of elongated fin members 336 may be oriented relative to one another in a helical pattern along the longitudinal length of the central rod 334.

In some embodiments, the central rod 334 may be configured to generally extend along a center longitudinal axis of the production tubing 114 when inserted into the production tubing 114. Furthermore, the flow regime modifier 332 may be sized and shaped to at least substantially span an inner diameter of the production tubing 114 when inserted into the production tubing 114.

In one or more embodiments, the flow regime modifier 332 may include a metal or a metal alloy. For instance, the flow regime modifier 332 may include one or more of iron, copper, steel, stainless steel, nickel, Inconel, carbon steel, alloys of any of the foregoing materials, etc. In additional embodiments, the flow regime modifier 332 may include a polymer or ceramic. Depending on the conditions of the well, the material of the flow regime modifier 332 may be selected to be corrosion resistant, abrasion resistant, etc., to suit a specific application.

Additionally and as noted above, in some embodiments, the flow regime modifier 332 may be disposed within only one or more sections of the production tubing 114 and may not extend through an entire length of the production tubing 114. In other embodiments, the flow regime modifier 332 may extend throughout at least substantially an entire length of the production tubing 114.

Furthermore, in one or more embodiments, the flow regime modifier 332 may include a static flow regime modifier. For instance, the flow regime modifier 332 may be stationary within the production tubing 114 during operation of the gas-lift well 100. In other embodiments, the flow regime modifier 332 may include a dynamic flow regime modifier. For example, the flow regime modifier 332 may be configured to constantly or intermittently move and/or change during operation of the gas-lift well 100. As a non-limiting example, the flow regime modifier 332 may include a motor mounted to one longitudinal end of the flow regime modifier 332, and the motor may rotate the entire flow regime modifier 332 during operation. As will be appreciated by one of ordinary skill in the art, the motor may be operated and controlled by the control system 126. In further embodiments, the flow regime modifier 332 may include one or more solenoids, motors, etc., mounted to the flow regime modifier 332 and configured to move only portions (e.g., the fin members) of the flow regime modifier 332.

Figure 4:
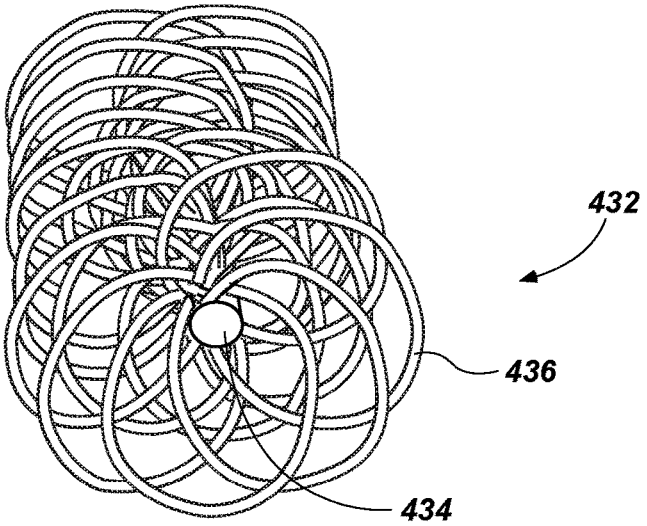
FIG. 4 is a perspective view of a flow regime modifier according to one or more embodiments of the present disclosure.

FIG. 4 is a perspective view of a flow regime modifier 432 according to one or more embodiments of the present disclosure. Referring to FIGS. 1 and 4 together, in some embodiments, the flow regime modifier 432 may include a central rod 434 with a plurality of circular fin members 436 extending radially outward from the central rod 434.

In some embodiments, each of the circular fin members 436 may include a circular loop of material. Furthermore, the central rod 434 may extend through an opening defined by the inner diameter of each of the circular fin members 436, and the central rod 434 may be secured to a surface of the inner diameter of each of the circular fin members 436. Furthermore, the plurality of circular fin members 436 may be oriented relative to one another in a general helical pattern along the longitudinal length of the central rod 434. Moreover, the circular fin members 436 are not limited to a circular shape and may have any circular or oval shape. In additional embodiments, the flow regime modifier 432 may not include a central rod, and rather, the circular fin members 436 may be attached directly to one another.

In some embodiments, the central rod 434 may be configured to generally extend along a center longitudinal axis of the production tubing 114 when inserted into the production tubing 114. Furthermore, the flow regime modifier 432 may be sized and shaped to at least substantially span a diameter of the production tubing 114 when inserted into the production tubing 114. In one or more embodiments, the flow regime modifier 432 may include any of the materials described above in regard to FIG. 3.

Additionally, similar to the flow regime modifier 332 described above in regard to FIG. 3, the flow regime modifier 432 may be disposed within only one or more sections of the production tubing 114 and may not extend through an entire length of the production tubing 114. In other embodiments, the flow regime modifier 432 may extend throughout at least substantially an entire length of the production tubing 114.

Furthermore, similar to the flow regime modifier 332 described above in regard to FIG. 3, the flow regime modifier 432 may include a static flow regime modifier. For instance, the flow regime modifier 432 may be stationary within the production tubing 114 during operation of the gas-lift well 100. In other embodiments, the flow regime modifier 432 may include a dynamic flow regime modifier. For example, the flow regime modifier 432 may be configured to move during operation of the gas-lift well 100. As a non-limiting example, the flow regime modifier 432 may include a motor mounted to one longitudinal end of the flow regime modifier 432, and the motor may rotate the entire flow regime modifier 432 during operation. As will be appreciated by one of ordinary skill in the art, the motor may be operated and controlled by the control system 126. In further embodiments, the flow regime modifier 432 may include one or more solenoids, motors, etc., mounted to the flow regime modifier 432 and configured to move only portions (e.g., the fin members) of the flow regime modifier 432 relative to the production tubing 114 and/or fluid column.

Figure 5:
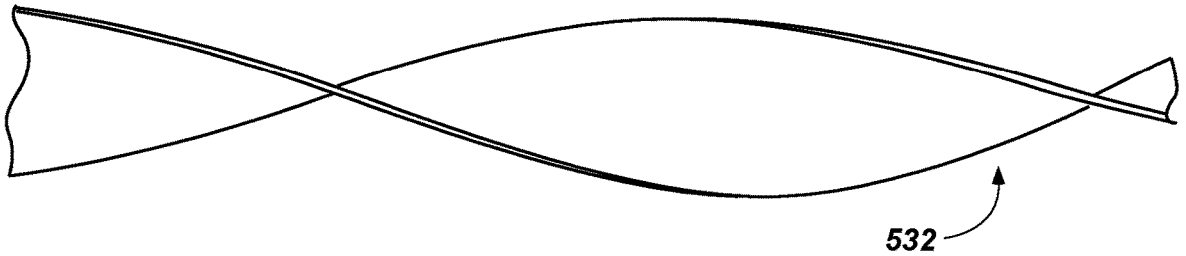
FIG. 5 shows a side view of a flow regime modifier according to one or more embodiments of the present disclosure.

FIG. 5 shows a side view of a flow regime modifier 532 according to one or more embodiments of the present disclosure. Referring to FIGS. 1 and 5 together, in some embodiments, the flow regime modifier 532 may include a twisted bar. Additionally, similar to the flow regime modifier 332 described above in regard to FIG. 3, in some embodiments, the flow regime modifier 532 may be disposed within only one or more sections of the production tubing 114 and may not extend through an entire length of the production tubing 114. In other embodiments, the flow regime modifier 532 may extend throughout at least substantially an entire length of the production tubing 114. In one or more embodiments, the flow regime modifier 532 may include any of the materials described above in regard to FIG. 3.

Furthermore, similar to the flow regime modifier 332 described above in regard to FIG. 3, the flow regime modifier 532 may include a static flow regime modifier. For instance, the flow regime modifier 532 may be stationary within the production tubing 114 during operation of the gas-lift well 100. In other embodiments, the flow regime modifier 532 may include a dynamic flow regime modifier. As a non-limiting example, the flow regime modifier 532 may include a motor mounted to one longitudinal end of the flow regime modifier 532, and the motor may rotate the entire flow regime modifier 532 during operation. As will be appreciated by one of ordinary skill in the art, the motor may be operated and controlled by the control system 126.

Figure 6:
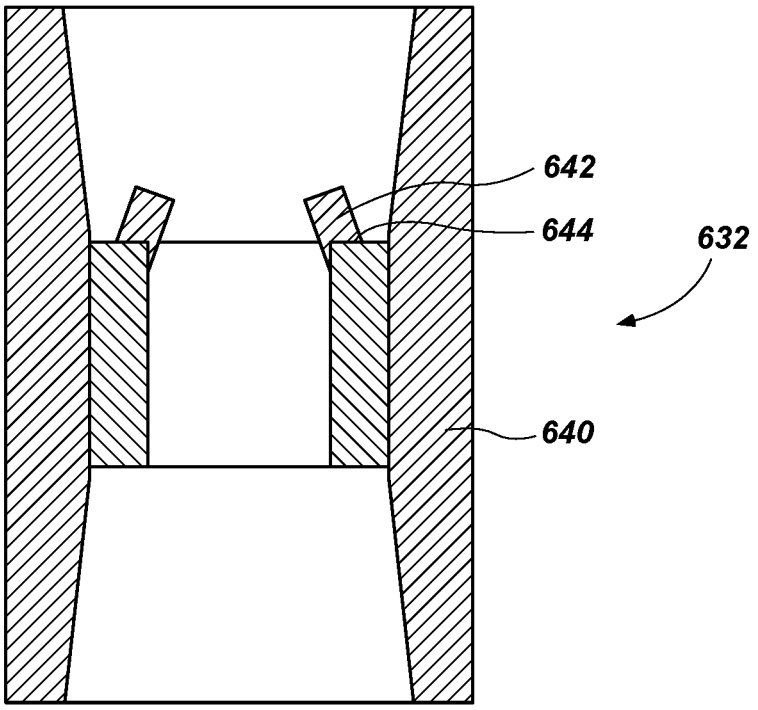
FIG. 6 is a cross-sectional view of a flow regime modifier according to one or more embodiments of the present disclosure.

FIG. 6 is a cross-sectional view of a flow regime modifier 632 according to one or more embodiments of the present disclosure. Referring to FIGS. 1 and 6 together, in some embodiments, the flow regime modifier 632 may include a coupling 640 that is disposed between sections of production tubing 114 for coupling the sections together. In some embodiments, the coupling 640 may include one or more protrusions 642 extending at least partially radially inward from the coupling 640 and into the fluid column.

In some embodiments, the protrusions 642 may be actuatable. For instance, the coupling 640 may include one or more actuators 644 (e.g., motors, solenoids, etc.) coupled to the protrusions 642, the actuators 644 may be configured to adjust how much a respective protrusion 642 extends into the fluid column. For instance, the actuators 644 may be configured to control how far radially inward the protrusions 642 extend from the coupling 640. The actuators 644 may be controlled by the control system 126.

Figure 7:
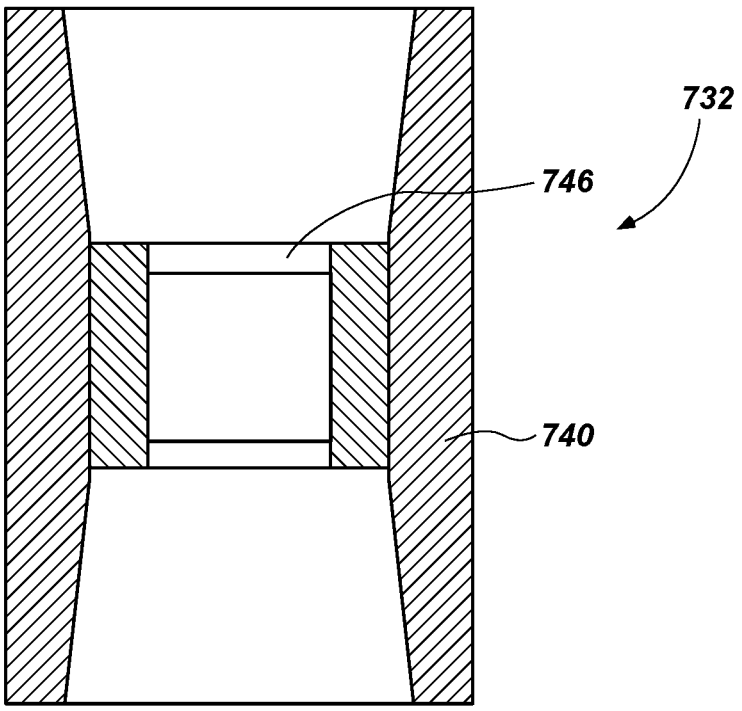
FIG. 7 is a cross-sectional view of a flow regime modifier according to one or more embodiments of the present disclosure.

FIG. 7 is a cross-sectional view of a flow regime modifier 732 according to one or more embodiments of the present disclosure. Referring to FIGS. 1 and 7 together, similar to the flow regime modifier 632 of FIG. 6, the flow regime modifier 732 may include a coupling 740 that is disposed between sections of production tubing 114 for coupling the sections together. In some embodiments, the coupling 740 may include one or more extensions 746 extending across the fluid column and the production tubing 114. Each extension may include a bar, rod, mesh material, etc.

Figure 8:
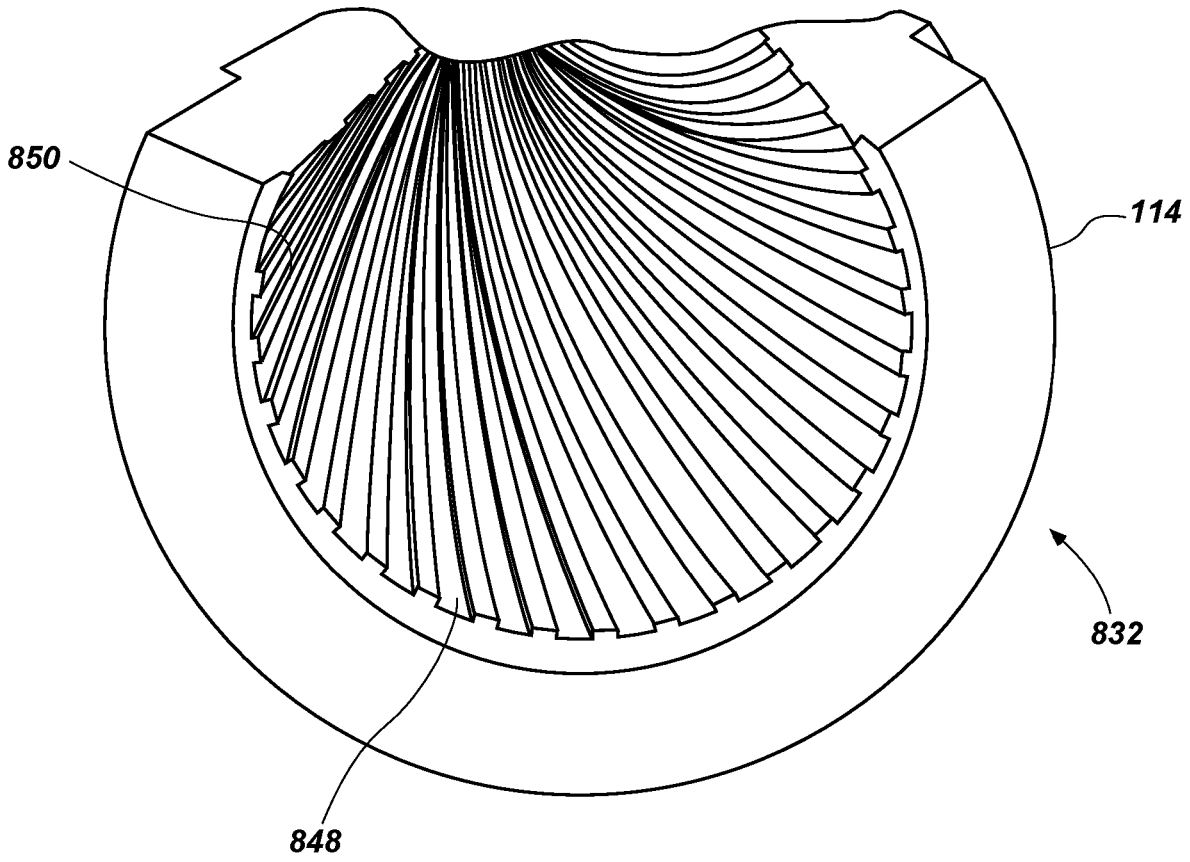
FIG. 8 is a partial cross-sectional perspective view of a flow regime modifier according to one or more embodiments of the present disclosure.

FIG. 8 is a partial cross-sectional perspective view of a flow regime modifier 832 according to one or more embodiments of the present disclosure. Referring to FIGS. 1 and 8 together, the flow regime modifier 832 may include an array of spiral grooves 848 formed in an inner surface 850 of the production tubing 114. For instance, the flow regime modifier 832 may include rifling. In some embodiments, the flow regime modifier 832 may extend along an entire length of the production tubing 114. In other embodiments, the flow regime modifier 832 may be formed in one or more sections of the production tubing 114.

Figure 9:
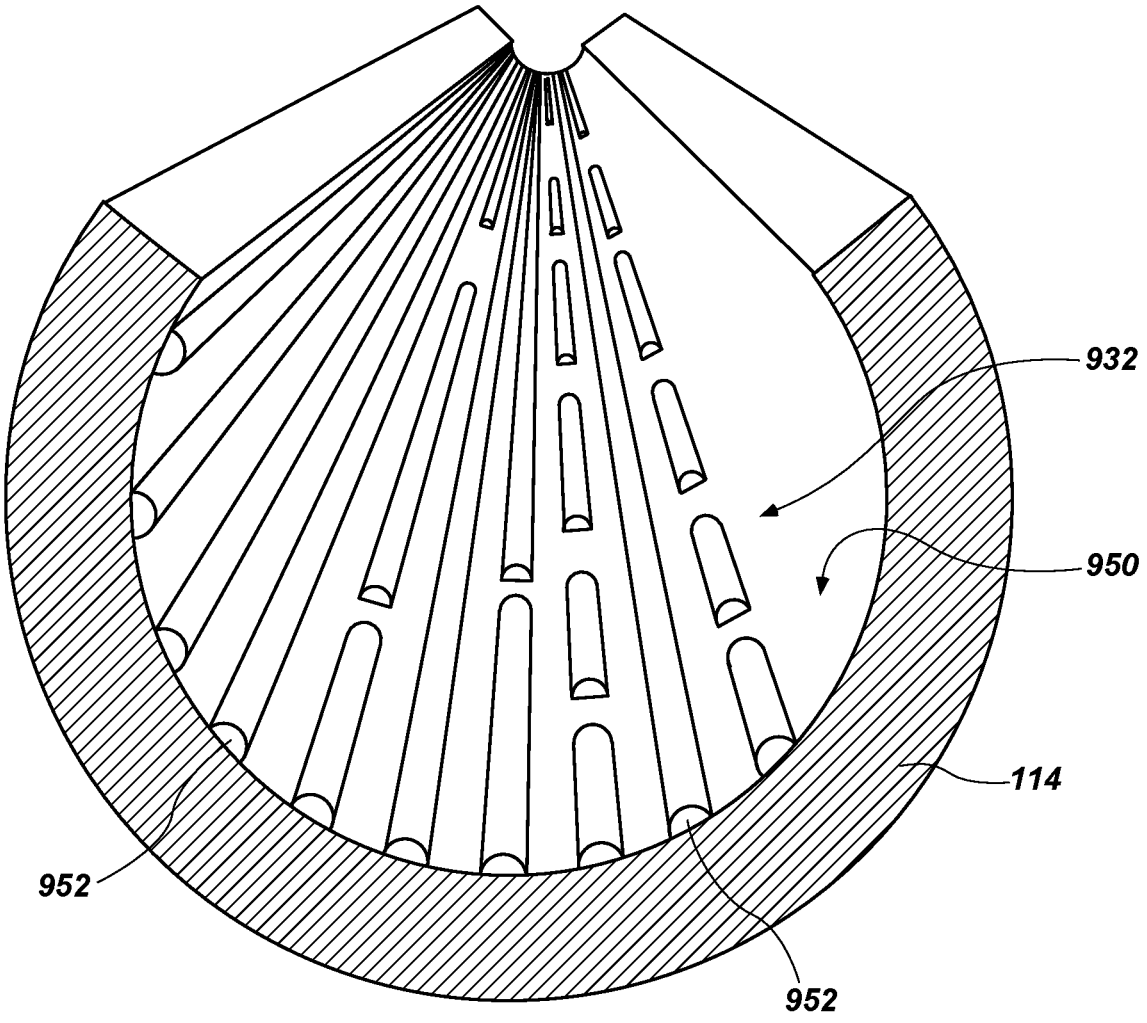
FIGS. 9 and 10 show partial cross-sectional perspective views of flow regime modifiers according to one or more embodiments of the present disclosure.
Figure 10:
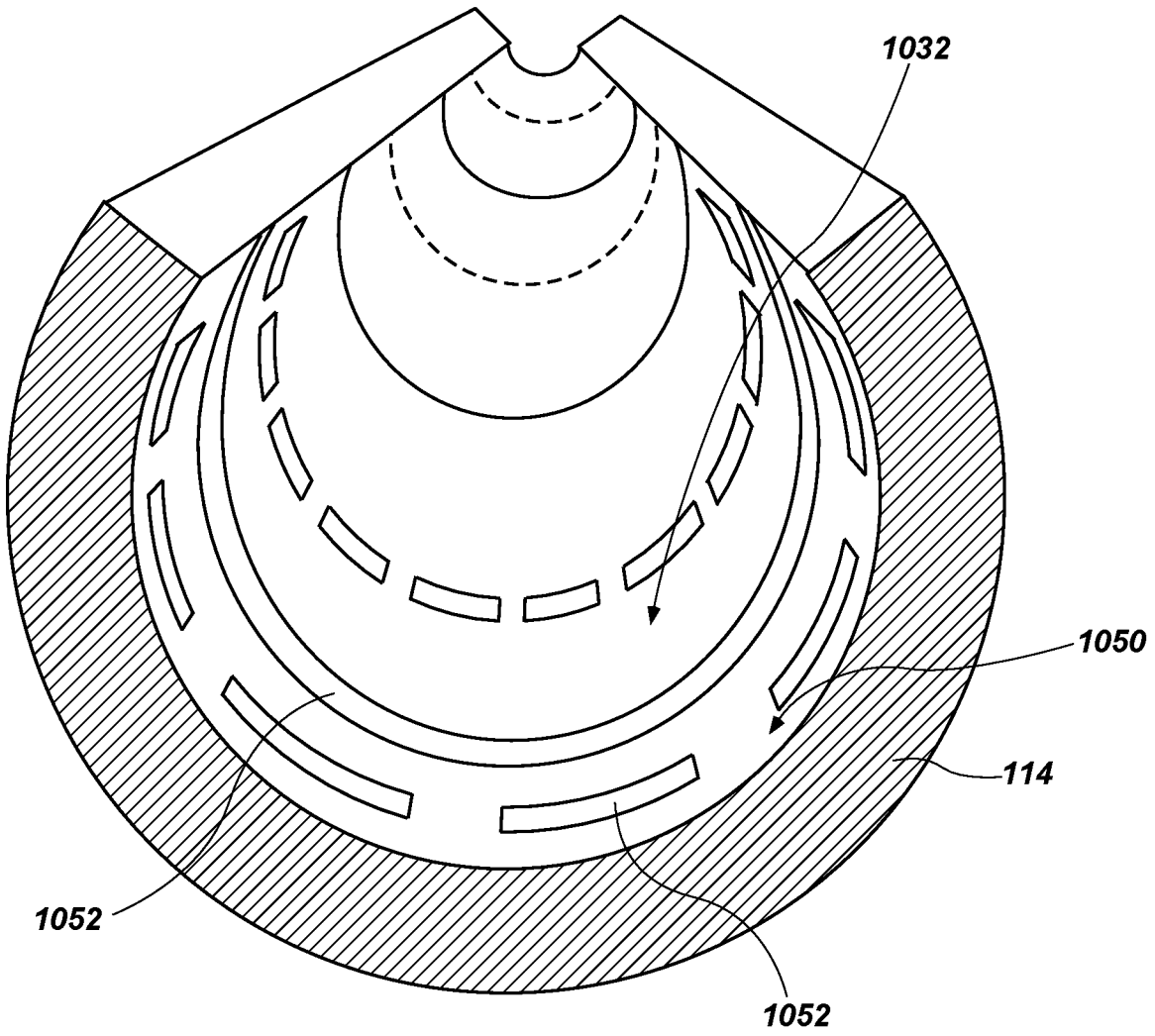

FIGS. 9 and 10 show partial cross-sectional perspective views of flow regime modifiers 932, 1032 according to one or more embodiments of the present disclosure. Referring to FIGS. 1, 9, and 10 together, the flow regime modifier 932, 1032 may include one or more or an array of ribs 952, 1052 formed on an inner surface 950, 1050 of the production tubing 114. In some embodiments, the ribs 952 may extend in direction at least substantially parallel to a longitudinal axis of the production tubing 114, as shown in FIG. 9. In other embodiments, the ribs 1052 may extend in a direction oblique to or perpendicular to the longitudinal axis of the production tubing 114, as shown in FIG. 10. As shown in FIGS. 9 and 10, in one or more embodiments, the ribs 952, 1052 may vary in length and thickness. In some embodiments, the ribs 952, 1052 may be formed along an entire length of the production tubing 114. In other embodiments, the ribs 952, 1052 may be formed in one or more sections of the production tubing 114.

Figure 11:
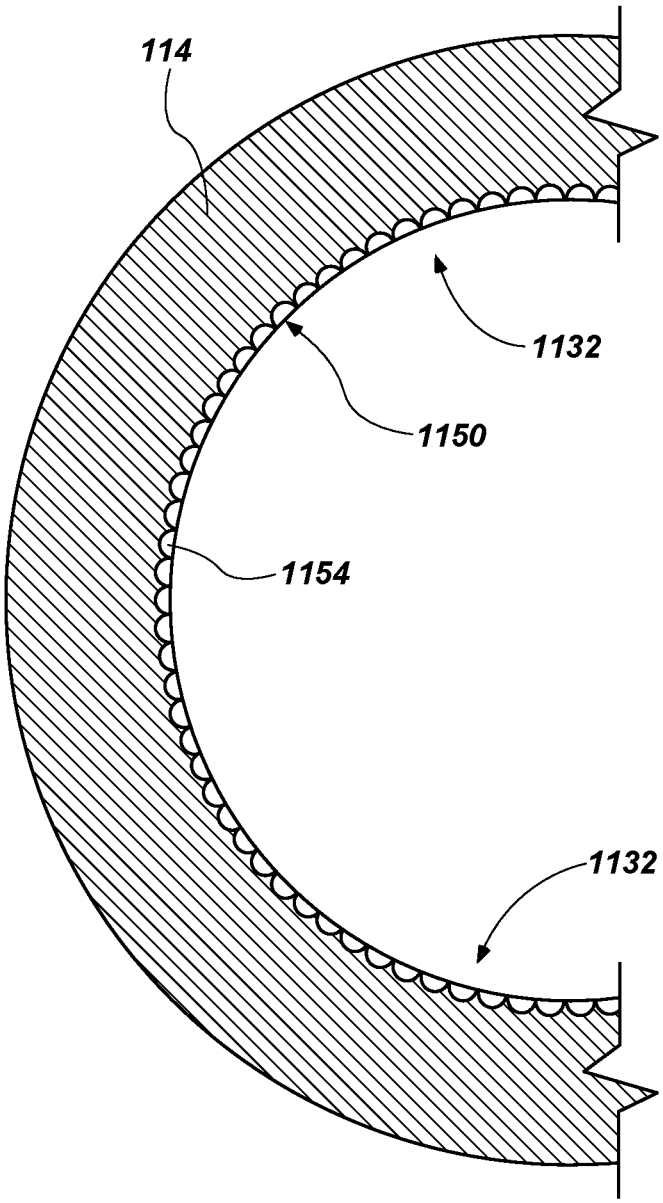
FIG. 11 shows a partial cross-sectional view of a production tubing and a flow regime modifier according to one or more embodiments of the present disclosure.

FIG. 11 shows a cross-sectional view of a production tubing 114 and a flow regime modifier 1132 according to one or more embodiments of the present disclosure. In some embodiments, the flow regime modifier 1132 may include a plurality of hemispherical recesses 1154 (e.g., dimples) or partial spherical recesses formed in the inner surface 1150 of the production tubing 114. For instance, the inner surface 1150 may generally resemble a surface of a golf ball. In some embodiments, the plurality of hemispherical recesses 1154 may be formed along an entire length of the production tubing 114. In other embodiments, the plurality of hemispherical recesses 1154 may be formed in one or more sections of the production tubing 114. In additional embodiments, the flow regime modifier 1132 may include recesses having shapes other than or in addition to the hemispherical recesses 1154. As a non-limiting example, the flow regime modifier 1132 may include rectangular, polyhedral, or any other shaped recesses. In additional embodiments, the inner surface of the production tubing 114 may include a relatively smooth surface with one or more protrusions extending radially inward into a flow cross-section of the fluid column. The one or more protrusions may be spaced throughout the entire length of the production tubing 114, or spaced in sections of the production tubing 114. Heights of protrusions may be varied throughout a length of the production tubing.

Referring to FIGS. 2-11 together, in some embodiments, the gas-lift well 100 may include any combination of the flow regime modifiers 132-1132 described above. For example, the gas-lift well 100 may include the flow regime modifier 132 of FIG. 1 disposed within the production tubing 114 and the flow regime modifier 1132 of FIG. 11 formed in the inner surface 1150 of the production tubing 114.

As mentioned above, the flow regime modifiers described herein may impart a turbulent flow regime in the fluid column within the production tubing 114. For example, the flow regime modifiers may create turbulent flow patterns within the fluid column to mix liquid and gas phases and prevent and/or reduce fluid fallback. Additionally, the turbulent flow patterns reduce the occurrence of a high velocity gas core (e.g., a phenomena where the gas core does not impart energy to the liquid) that is typically present in the annular flow regime described in regard to FIG. 2. In particular, the flow regime modifier 132 may cause sufficient energy to be transferred from the gas 202 (i.e., the compressed gas injected into the production tubing 114) to the liquid 204 (e.g., hydrocarbons) to at least substantially prevent fluid fallback without an excessive pressure drop that typically occurs in the annular flow.

Additionally, the flow regime modifiers add solid surface area within the production tubing 114, and the solid surface area increases a level of surface tension between the liquid and the outer surface of the flow regime modifiers. The increased surface tension between the liquid and the outer surface of the flow regime modifiers assist in reducing fluid fallback. Moreover, in some embodiments, the flow regime modifiers reduce a cross-sectional area through which the two-phase fluid can flow. As a result, the flow regime modifiers increase a velocity at which the two-phase fluid travels through the production tubing 114. The increased velocity enables a same amount of energy to be transferred from the gas to the liquid with less overall injected gas. Accordingly, the flow regime modifiers increase an effectiveness of the injected gas.

Additional non limiting example embodiments of the disclosure are described below.

Embodiment 1

A gas-lift well system, comprising: a casing extending down a wellbore; production tubing extending within the casing; a gas system for introducing compressed gas into an annular space between the casing and the production tubing; at least one gas-lift input extending from the annular space to an interior of the production tubing; and at least one fluid flow regime modifier within the production tubing and at least partially within a fluid column of the production tubing, the at least one fluid flow regime modifier configured to reduce fluid fallback and impart a turbulent flow regime to at least a portion of the fluid column.

Embodiment 2

The gas-lift well system of embodiment 1, wherein the at least one fluid-flow regime modifier comprises: a central rod extending along a longitudinal length of the production tubing and at least substantially centered within the production tubing; and a plurality of fin members extending radially outward from the central rod.

Embodiment 3

The gas-lift well system of embodiment 2, wherein each fin member of the plurality of fin members comprises a loop of material.

Embodiment 4

The gas-lift well system of embodiments 2 and 3, wherein the plurality of fin members are oriented next to each other in a helix pattern along a longitudinal length of the central rod.

Embodiment 5

The gas-lift well system of embodiment 1, wherein the at least one fluid-flow regime modifier comprises a twisted bar of material.

Embodiment 6

The gas-lift well system of embodiment 1, wherein the at least one fluid-flow regime modifier comprises a coupling between production tubing sections, the coupling comprising at least one protrusion extending radially inward into the fluid column from the coupling.

Embodiment 7

The gas-lift well system 1 of embodiment 1, wherein the at least one fluid-flow regime modifier comprises at least one rib formed on an inner surface of the production tubing.

Embodiment 8

The gas-lift well system of embodiments 1 and 7, wherein the at least one fluid-flow regime modifier comprises at least one rib formed on an inner surface of the production tubing and extending in a direction oblique to the longitudinal length of the production tubing.

Embodiment 9

The gas-lift well system of embodiment 1, wherein the at least one fluid-flow regime modifier comprises an array of spiral grooves formed in an inner surface of the production tubing.

Embodiment 10

The gas-lift well system of embodiment 1, wherein the at least one fluid-flow regime modifier comprises a plurality of dimples formed in the inner surface of the production tubing.

Embodiment 11

A gas-lift well system, comprising: a casing extending down a wellbore; production tubing extending within the casing; a gas system for introducing compressed gas into an annular space between the casing and the production tubing; at least one gas-lift input extending from the annular space to an interior of the production tubing; and at least one fluid flow regime modifier within the production tubing and at least partially within a fluid column of the production tubing, the at least one fluid flow regime modifier configured to reduce fluid fallback and cause fluid flow within the fluid column proximate a wall of the production tubing to move toward a center of the fluid column and fluid flow near a center of the fluid column to move toward the wall of the production tubing.

Embodiment 12

The gas-lift well system of embodiment 11, wherein the at least one fluid flow regime modifier is configured to increase a velocity at which the fluid column travels through the production tubing.

Embodiment 13

The gas-lift well system of embodiments 11 and 12, wherein the at least one fluid flow regime modifier comprises a plurality of fin members extending radially outward from a center axis.

Embodiment 14

The gas-lift well system of embodiments 13, wherein each fin member of the plurality of fin members comprises a loop of material.

Embodiment 15

The gas-lift well system of embodiments 13 and 14, wherein the plurality of fin members are oriented next to each other in a helix pattern along a longitudinal length of the center axis.

Embodiment 16

The gas-lift well system of embodiments 11 and 12, wherein the at least one fluid-flow regime modifier comprises a coupling between production tubing sections, the coupling comprising at least one cross-member extending across the fluid column.

Embodiment 17

A method of installing a fluid flow regime modifier, comprising providing at least one fluid flow regime modifier within production tubing of a wellbore and at least partially within a fluid column of the production tubing, the at least one fluid flow regime modifier configured to reduce fluid fallback and impart a turbulent flow regime to at least a portion of the fluid column.

Embodiment 18

The method of embodiment 17, wherein providing at least one fluid flow regime modifier within production tubing comprises disposing a central rod that extends along a longitudinal length of the production tubing, the central rod having a plurality of wing members extending radially outward from the central rod.

Embodiment 19

The method of embodiment 17, wherein providing at least one fluid flow regime modifier within production tubing comprises disposing a coupling between production tubing sections, the coupling comprising at least one cross-member extending across the fluid column.

Embodiment 20

The method of embodiment 17, wherein providing at least one fluid flow regime modifier within production tubing comprises at least one of forming a plurality of dimples in an inner surface of the production tubing, forming a plurality of ribs on an inner surface of the production tubing, and forming a plurality of spiral grooves in an inner surface of the production tubing.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A gas-lift well system, comprising:

a casing extending down a wellbore; production tubing extending within the casing;

a gas system for introducing compressed gas into an annular space between the casing and the production tubing;

at least one gas-lift input extending from the annular space to an interior of the production tubing; and at least one fluid flow regime modifier within the production tubing and at least partially within a fluid column of the production tubing, the at least one fluid flow regime modifier configured to reduce fluid fallback and impart a turbulent flow regime to at least a portion of the fluid column, the at least one fluid flow regime modifier comprising:

a central rod extending along a longitudinal length of the production tubing and at least substantially centered within the production tubing; and a plurality of fin members extending radially outward from the central rod, wherein each fin member of the plurality of fin members comprises at least one loop of material extending from a first point on an outer surface of the central rod to a second point on an outer surface of the central rod, wherein a line extending between the first point and the second point defines an axis that is parallel to a central longitudinal axis of the central rod.

2. The gas-lift well system of claim 1, wherein the plurality of fin members are oriented next to each other in a helix pattern along a longitudinal length of the central rod.

3. A gas-lift well system, comprising:

a casing extending down a wellbore; production tubing extending within the casing;

a gas system for introducing compressed gas into an annular space between the casing and the production tubing;

at least one gas-lift input extending from the annular space to an interior of the production tubing; and at least one fluid flow regime modifier within the production tubing and at least partially within a fluid column of the production tubing, the at least one fluid flow regime modifier configured to reduce fluid fallback and cause fluid flow within the fluid column proximate a wall of the production tubing to move toward a center of the fluid column and fluid flow at a center of the fluid column to move toward the wall of the production tubing, the at least one fluid flow regime modifier comprising:

a central rod extending along a longitudinal length of the production tubing and at least substantially centered within the production tubing; and a plurality of fin members extending radially outward from the central rod, wherein each fin member of the plurality of fin members comprises at least one loop of material extending from a first point on an outer surface of the central rod to a second point on an outer surface of the central rod wherein a line extending between the first point and the second point defines axis that is parallel to a central longitudinal axis of the central rod.

4. The gas-lift well system of claim 3, wherein the at least one fluid flow regime modifier is configured to increase a velocity at which the fluid column travels through the production tubing.

5. The gas-lift well system of claim 3, wherein the plurality of fin members are oriented next to each other in a helix pattern along a longitudinal length of the center axis.

6. A method of installing a fluid flow regime modifier, comprising:

providing at least one fluid flow regime modifier within production tubing of a wellbore and at least partially within a fluid column of the production tubing, wherein providing at least one fluid flow regime modifier within production tubing comprises a central rod that extends along a longitudinal length of the production tubing, the central rod having a plurality of fin members extending radially outward from the central rod, wherein each fin member of the plurality of fin members comprises at least one loop of material extending from a first point on an outer surface of the central rod to a second point on an outer surface of the central rod wherein a line extending between the first point and the second point defines an axis that is parallel to a central longitudinal axis of the central rod, the at least one fluid flow regime modifier configured to reduce fluid fallback and impart a turbulent flow regime to at least a portion of the fluid column.

* * * * *